United States Patent [19]

Adams et al.

[11] Patent Number: 5,039,534

[45] Date of Patent: Aug. 13, 1991

[54] PEA SEPARATING APPARATUS AND METHOD OF USE

[75] Inventors: Timm L. Adams, Eden Prairie; Leon Levine, Plymouth; George R. Anderson, Minneapolis, all of Minn.

[73] Assignee: The Pillsbury Company, Minneapolis, Minn.

[21] Appl. No.: 542,426

[22] Filed: Jun. 22, 1990

[51] Int. Cl.[5] ..... B03B 5/00; B07B 11/00

[52] U.S. Cl. ..... 426/231; 99/536; 99/570; 209/156; 426/507; 426/481

[58] Field of Search ..... 426/481, 507, 231; 99/536, 570, 516; 209/155, 156; 250/338.1

[56] References Cited

U.S. PATENT DOCUMENTS

| | | | |
|---|---|---|---|
| 1,374,657 | 4/1921 | Hiller | 99/570 |
| 3,902,587 | 9/1975 | Checcucci | 198/34 |
| 4,169,787 | 10/1979 | Gunnerson | 209/173 |
| 4,311,241 | 1/1982 | Lacy, Jr. et al. | 209/570 |
| 4,375,853 | 3/1983 | Feller et al. | 209/640 |
| 4,576,071 | 3/1966 | Rayment | 83/71 |
| 4,750,995 | 6/1988 | Fogerson | 289/173 |
| 4,795,651 | 1/1989 | Henderson et al. | 426/456 |
| 4,858,769 | 8/1989 | DeVries | 289/3.1 |
| 4,946,584 | 8/1990 | Olney | 209/156 |

FOREIGN PATENT DOCUMENTS 1334248 10/1973 United Kingdom .

OTHER PUBLICATIONS

Bran+Luebbe Analyzing Technologies, Inc., "The Systems Approach to Near Infrared Analyzers from Research & Development through Process Control", 12 pages.

A. Mizrach et al., "Gravitational Motion of Spheres in a Fluidized Bed," *Transactions of the ASAE,* 1984, pp. 1674–1678.

W. L. Dalmijn et al., "High Capacity Fluid Bed Separator for Simultaneous Sizing and Gravity Separation", *Aufbereitungs-Technik,* 11/1981, pp. 611–618.

A. W. Nienow et al., "The Effect of Shape on the Mixing and Segregation of Large Particles in a Gas-Fluidized Bed of Small Ones", *Int. Fluidization Conf.,* 1980, pp. 373–380.

Tse-Chuan Chou et al., "Separation of Particles in a Modified Fluidized Bed by a Distributor with Dead--Zone Collector", *Ind. Eng. Chem. Process Des. Dev.,* vol. 24, No. 3, 1985, pp. 683–686.

R. Tkachuk et al., "Analysis of Protein in Ground and Whole Field Peas by Near-Infrared Reflectance", *Cereal Chemistry,* vol. 64, No. 6, 1987, pp. 418–421.

Philip C. Williams et al., "Determination of Methionine in Peas by Near-Infrared Reflectance Spectroscopy (NIRS)", *J. Agric. Food Chem.,* vol. 33, No. 5, 1985, pp. 811–815.

Faust et al., "Principles of Unit Operations", 1964, pp. 454–456.

McCabe et al., "Mechanical Separations", 1976, pp. 961–963.

Association of Official Analytical Chemists, "Official Methods of Analysis", 1984, p. 614.

*Primary Examiner*—George Yeung

*Attorney, Agent, or Firm*—Kinney & Lange

[57] ABSTRACT

An apparatus and method for separating peas based upon differences in density. The apparatus includes a flow trough having a flow manifold. A pump takes water from a reservoir and delivers the water to the flow manifold. A flow nipple having a lip portion extending into the flow manifold and turning vanes within the flow manifold distribute the water to create a substantially laminar flow. Fixed and pivotable water deflectors at an inlet portion of the flow trough establish a linear, laminar flow of water along the flow trough. A hopper and conveyor combination deliver a stream of peas to an adjustable plate member positioned in the laminar flow of water in the flow trough. The peas carried by the laminar flow of water descend off of the plate member into a separating chamber where peas having a high density range settle into a first collecting chamber and peas with a low density range settle into a second collecting chamber. An adjustable separating vane separates the first and second collecting chambers and together with the plate member is adjusted to accommodate batches of peas having differing density characteristics.

27 Claims, 5 Drawing Sheets

PEA SEPARATING APPARATUS AND METHOD OF USE

BACKGROUND OF THE INVENTION

This invention pertains generally to devices and methods for the liquid separation of food pieces based upon differences in density. In particular, the present invention relates to an apparatus and method for the liquid separation of young peas from mature peas based upon their starch content.

A primary attribute of peas that is of concern to consumers is their sweetness. Pea sweetness depends upon the sugar content within the peas which is itself a function of pea maturity. Pea maturity is a measure of the starch content within the peas. As the peas mature, sugars initially present within the peas are converted to starch. This conversion occurs because starch is a better long term energy storage compound than is sugar. The amount of starch within the peas also affects the texture or mouth feel of the peas. Consumers prefer a tender mouth feel which translates into smooth, firm texture. As starch concentration increases within the peas, the peas tend to take on a tough texture.

Traditionally pea maturity (i.e., starch concentration) has been objectively calculated by a wet chemistry test that determines the percentage of Alcohol Insoluble Solids (AIS) within the pea. As a pea matures the amount of the alcohol insoluble solids within the pea increases while the amount of alcohol soluble solids decreases. AIS units represent the percentage of starch within the peas. For example, early peas which are usually high in sugar content have low starch concentrations and therefore a low AIS percentage, whereas mature peas picked later in the season have high starch concentrations and therefore a high AIS percentage. The accepted procedure for the calculation of AIS is designated as "Solids (Alcohol-Insoluble) in Frozen Peas, Gravimetric Method", 32.065 of the Association of Official Chemists. In addition to the AIS test, an instrument known as a Tenderometer (available from the FMC Corporation) is used to provide an initial rough estimation of the quality of a batch of peas based upon their relative tenderness.

As sugar is converted by the peas into starch, the density of the pea increases since starch in vivo is a more dense compound than sugar. Because of this difference in density, mature peas have been separated from young (high sugar) peas by formulating a brine solution of intermediate density calculated from data obtained by the AIS test and the use of the Tenderometer. The peas are dispensed into the static brine solution and the more mature peas with a high starch concentrations and thereby density in a high range tend to sink to the bottom of the brine solution. Younger, higher sugar peas with low starch concentrations and thereby density in a low range tend to float.

The use of a brine solution poses problems. One of these problems is the corrosion of equipment. The high salt concentration can cause metals within the pea separator to rust which may effect the taste of the peas. In addition, there is the greater problem of disposing of the brine solution after it has been used. Brine discharge could cause environmental problems by killing fish and seeping into ground water supplies. In addition, the density of the brine solution is determined for a single batch of peas. Therefore, the density of that brine solution can not be easily changed during the processing of the batch of peas to accommodate fluctuations in starch concentrations of the batch of peas during the separating process. Moreover, brine solutions of differing densities are required to separate batches of peas having different starch concentrations.

There is a continuing need for improved separation of mature peas from younger peas. In particular, there is a need for a pea separating apparatus and method that does not use a brine solution to carry out the density separation process. The pea separating apparatus should use a fluid medium that lessens the corrosion of the equipment and eliminates the disposal problem associated with brine solutions. The pea separating apparatus should readily permit adjustments to be made to the separating process to accommodate batches of peas having differing starch concentrations. Moreover, the pea separating apparatus should allow the separating process to be adjusted during the processing of a single batch of peas to accommodate starch concentration fluctuations within that batch.

SUMMARY OF THE INVENTION

The present invention provides a pea separating apparatus and method which separates peas based upon differences in density. The pea separating apparatus includes a supply system having a reservoir containing a supply of water. Water from the reservoir is pumped via a pump mechanism from the water reservoir to a flow manifold. The flow manifold includes angled end walls, turning vanes and a flow nipple that ensure that water entering the flow manifold is evenly distributed to achieve a substantially laminar flow of water. Water leaving the manifold enters a flow trough whereby a linear, substantially laminar flow of water is established.

The flow trough is divided into discrete channels which help maintain the laminar flow of water. Fixed and pivotable water deflectors at the inlet portion of the flow trough evenly distribute water pressure between the plurality of channels. Beneath the channels is positioned a separating chamber having cavity dividers arranged perpendicular to the channels. Peas are delivered to an adjustable plate within the flow trough via an endless conveyor and hopper combination. The peas accelerate to match the velocity of the laminar, linear flow water as they ride along the plate member. The peas then free fall from the end of the plate member where they descend through a separating chamber. Peas having a high starch concentration are denser and tend to descend at a relatively fast rate where they are received in a first collecting chamber positioned beneath the separating chamber. Peas having a low starch concentration tend to descend through the separating chamber at a relatively slow rate and are thereby received in a second separating chamber positioned distally or downstream of the first collecting chamber.

High starch and low starch peas within the first and second collecting chambers are delivered to first and second dewatering belts, respectively for dewatering. Water separated at the first and second dewatering belts is returned to the reservoir for recirculation to the flow trough. Water that does not pass into the first and second collecting chambers passes over a weir at an outlet portion of the flow trough where it is returned to the water reservoir for recirculation to the flow trough.

An adjustable separating vane is positioned between the first and second collecting chambers. The separating vane can be positioned in alignment with any one of the cavity dividers as desired to delineate the separation point between high starch peas and low starch peas. The plate member is adjustable and allows fine tuning adjustment of the separation point between high and low starch peas. The plate member and separating vane are set up in accordance with data from an AIS test and a Tenderometer conducted on the batch of peas to be separated. Retesting of the low starch peas from the second dewatering belt using a near infrared reflectance (NIR) analyzer provides further data to readjust the plate member and the separating vane during the separating process.

This pea separating apparatus is relatively uncomplicated. By separating mature peas (i.e., high starch concentration peas) from young peas (i.e., low starch concentration peas) using a recirculating linear, laminar flow of water, the need for a brine solution has been eliminated. Together with the elimination of the brine solution the problems of corrosion of equipment and the harm to the environment from the disposal of the brine solution has been eliminated. In addition, the use of a linear, laminar flow of water to separate the peas does away with the salty taste that could accompany peas separated in a brine solution. The adjustable plate member and separating vane readily permit the separation process of the pea separating apparatus to be quickly adjusted to accommodate batches of peas having differing starch concentrations. Moreover, by retesting the separated peas during the separating process the plate member and separating vane can be quickly readjusted to accommodate starch concentration fluctuations within the batch of peas currently being separated.

DETAILED DESCRIPTION OF THE PREFERRED EMBODIMENTS

Figure 1:
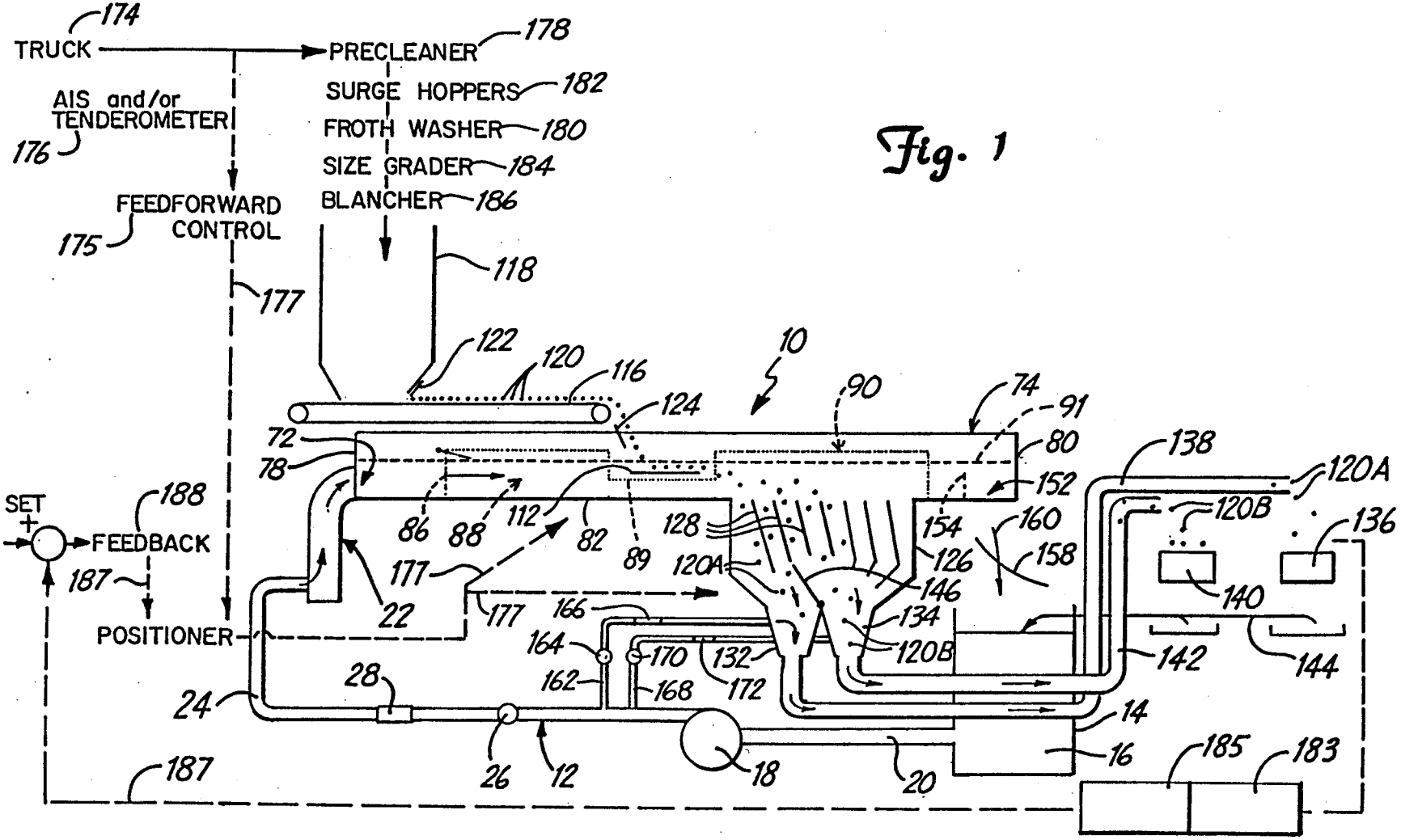
FIG. 1 is a side elevational view of a pea separating apparatus in accordance with the present invention.
Figure 2:
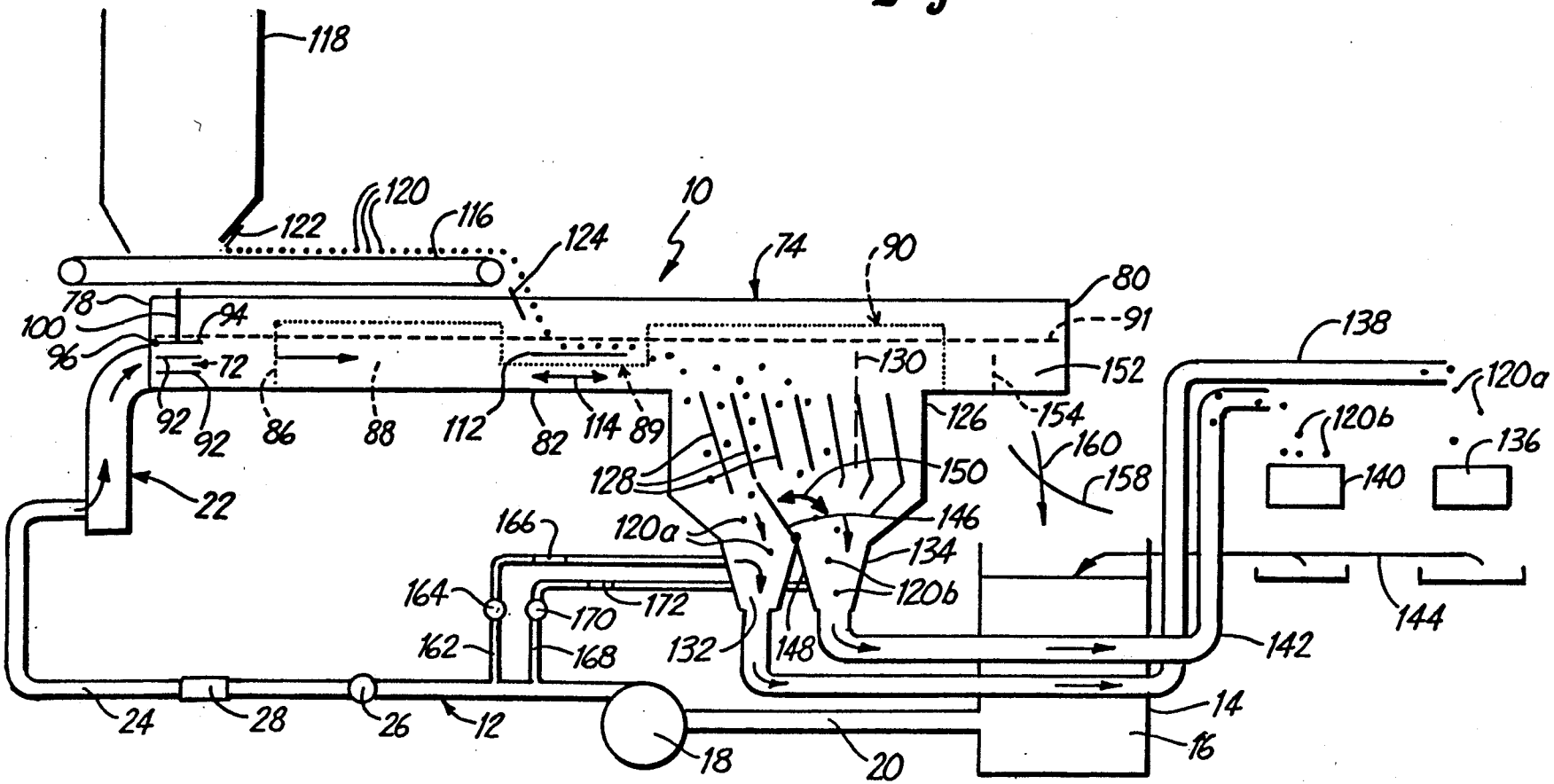
FIG. 2 is an enlarged side elevational view of the pea separating apparatus shown in FIG. 1.

A pea separating apparatus 10 in accordance with the present invention is illustrated generally in FIGS. 1 and 2. The pea separating apparatus 10 includes a closed loop flow system 12 having a reservoir 14. The reservoir 14 contains a supply of fluid medium, such as water 16, to be used in the separating process. A pump 18 is coupled to the reservoir 14 through a first supply line 20. The pump 18 takes water 16 from the reservoir 14 and delivers it to a flow manifold 22 through a second supply line 24. The second supply line 24 includes a valve 26 located at the bottom of the flow system 12 which allows the water flow rate to be regulated. A flow meter 28 positioned within the second supply line 24 permits monitoring of the flow of water 16 through the closed loop supply system 12 during the separating process.

Figure 4:
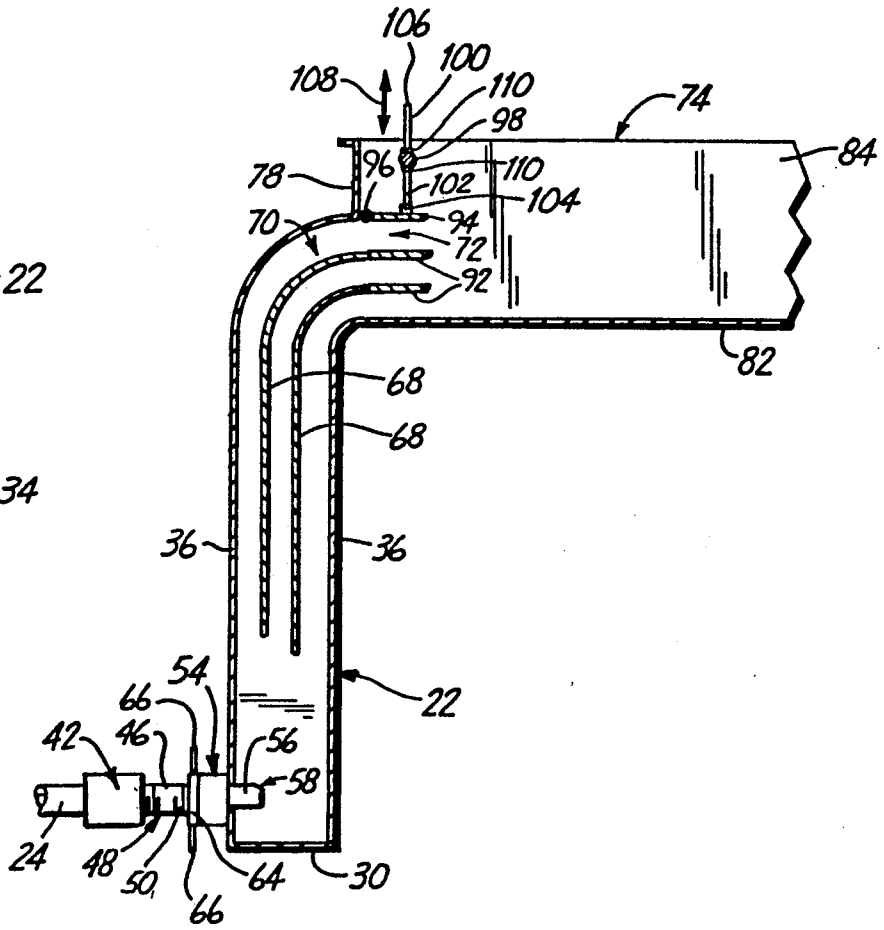
FIG. 4 is a sectional view taken along the line 4—4 in FIG. 3 illustrating the interior components of the flow manifold of a pea separating apparatus in accordance with the present invention.
Figure 3:
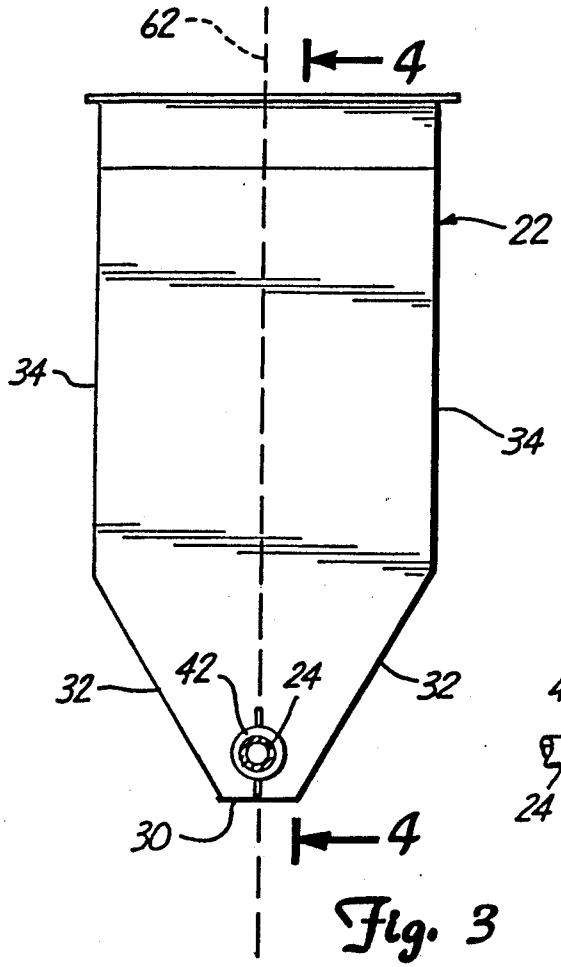
FIG. 3 is a side elevational view of the flow manifold of a pea separating apparatus in accordance with the present invention.
Figure 5:
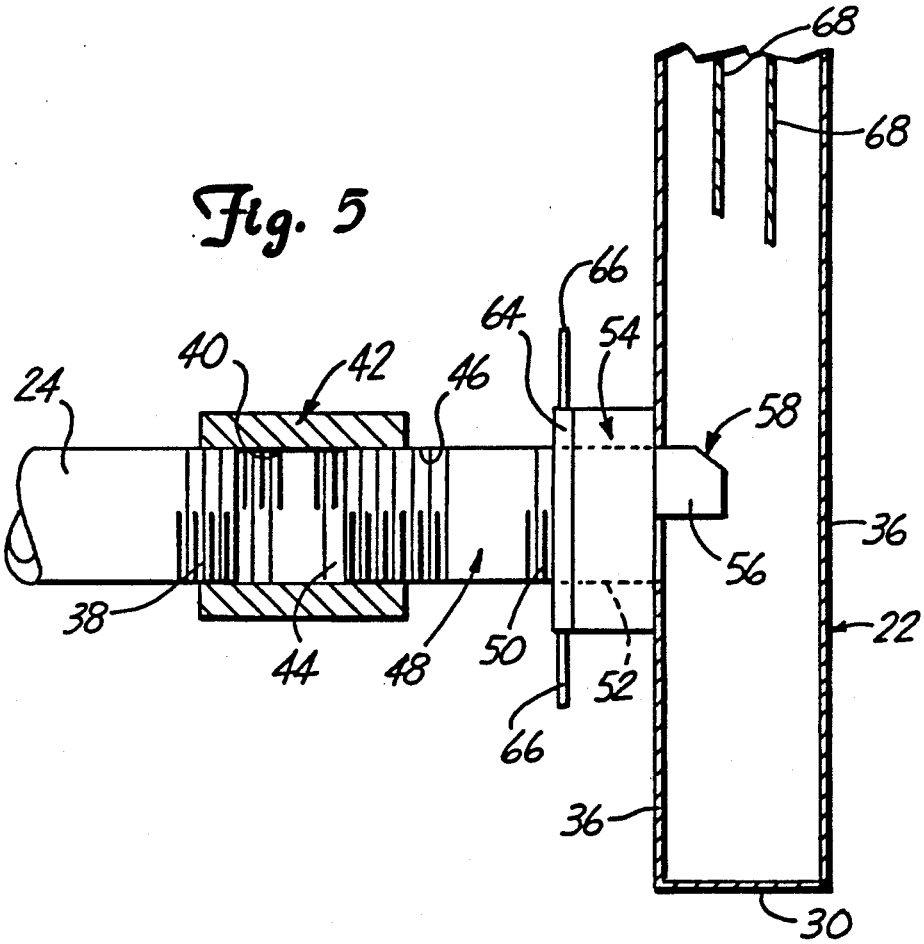
FIG. 5 is an enlarged sectional view similar to FIG. 4 illustrating the particulars of the flow nipple of a pea separating apparatus in accordance with the present invention.

As seen in FIG. 3, the flow manifold 22 includes a bottom wall 30, a pair of inclined end walls 32 that taper outwardly to a pair of parallel end walls 34, and a pair of side walls 36 (see FIGS. 4 and 5). The gradual taper of the inclined end walls 32 allows water 16 (introduced into the flow manifold 22 through the second supply line 24) to expand gradually due to the increased volume of the flow manifold 22 which in turn dissipates and distributes water flow pressure. This gradual expansion is more efficient than a sudden expansion and serves to reduce any turbulence. Reduced turbulence allows the water 16 to achieve substantially laminar flow as the water 16 travels up the flow manifold 22.

As seen in FIG. 5, the second supply line 24 has a threaded end portion 38 that cooperates with a threaded first end 40 of a sleeve member 42. A threaded second end 44 of the sleeve member 42 is adapted to receive a threaded first portion 46 of a flow nipple 48. The flow nipple 48 further includes a threaded second portion 50 that cooperates with a threaded through opening 52 within a coupling 54 fixed to one of the side walls 36 of the flow manifold 22.

Figure 6:
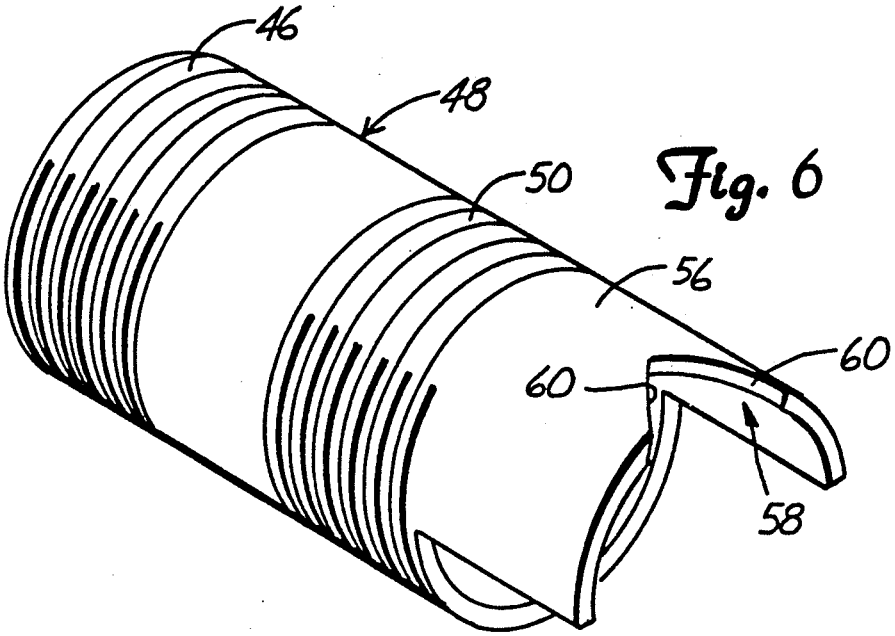
FIG. 6 is an enlarged perspective view of the flow nipple illustrated in FIG. 5.

As seen in FIG. 6, a semi-circular lip portion 56 extends outwardly from the threaded second end 50 of the flow nipple 48. The lip portion 56 includes a V-shaped notch 58 having angled walls 60. The lip portion 56 helps to evenly distribute the flow of water 16 as it leaves the second supply line 24 and enters the flow manifold 22. Without the lip portion 56, the flow rate of the water 16 through the flow manifold 22 would be higher along the center line 62 (see FIG. 3) of the flow manifold 22 than at the end walls 34. The use of the lip portion 56 without the V-shaped notch 58 results in higher water flow velocity near the end walls 34 as compared to the velocity of the water 16 at the center line 62. The V-shaped notch 58 allows the water pressure to be dissipated and evenly distributed across the width of the flow manifold 22.

The threaded first end 40 of the sleeve member 42 is threaded opposite to the threaded second end 44, such that as the sleeve member 42 is rotated the flow nipple 48 is drawn towards the second supply line 24. Hence, the extent to which the lip portion 56 extends into the interior of the flow manifold 22 can be varied to best distribute the water pressure and insure that the flow of water 16 up the flow manifold 22 is substantially laminar. The 90° turn of the flow of water 16 as it leaves the second supply line 24 and enters the flow manifold 22 also aids in evenly distributing the flow of water 16 across the width of the flow manifold 22.

As seen in FIG. 5, a lock nut 64 is threadably received on the second threaded portion 50 of the flow nipple 48. The lock nut 64 includes a pair of oppositely directed handles 66 that aid in rotating the lock nut 64. The lock nut 64 when loosened allows the sleeve 42 to be rotated to vary the position of the flow nipple 48 relative to the flow manifold 22. The lock nut 64 when tightened against the coupling 54, secures the flow nipple 48 in position.

As seen best in FIG. 4, the flow manifold 22 includes a pair of turning vanes 68 that extend between the end walls 34. The turning vanes 68 follow the contour of the flow manifold 22 and are curved near an outlet 70 of the flow manifold 22 to maintain the substantially laminar flow of water 16 up the flow manifold 22. The outlet 70 of the flow manifold 22 intersects an inlet portion 72 of a flow trough 74.

Figure 7:
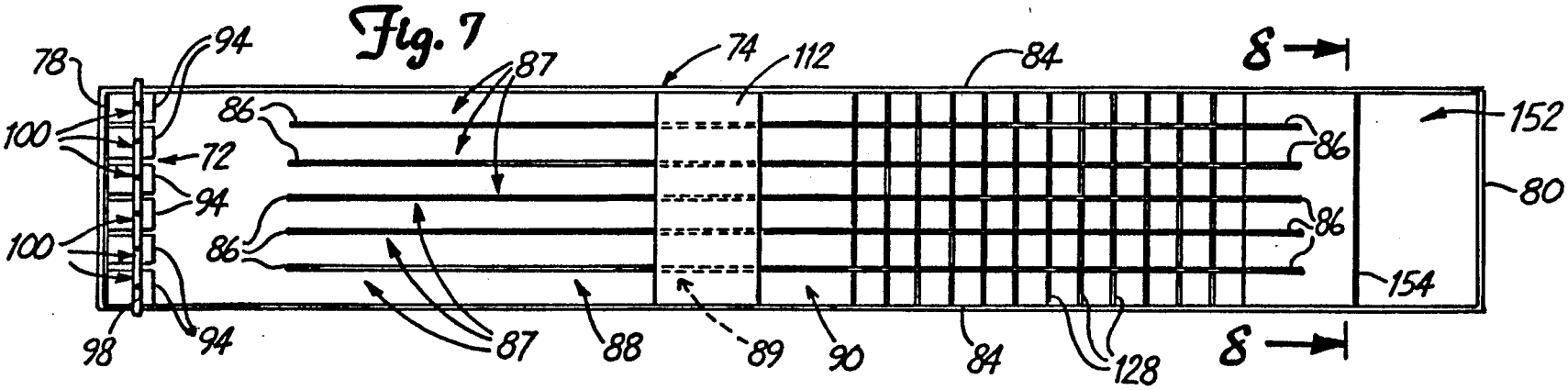
FIG. 7 is a top elevational view of the flow trough of a pea separating apparatus in accordance with the present invention.

As seen in FIGS. 1, 2 and 7, the flow trough 74 includes first and second end walls 78 and 80, respectively, a bottom wall 82 and a pair of side walls 84. Five divider walls 86 extend parallel to the side walls 84 of the flow trough 74. The divider walls 86 define a first channel section 88 of six flow channels 87, an intermediate short channel section 89 of six flow channels 87 and a second channel section 90 of six flow channels 87. The flow channels 87 of the first, intermediate and second channel sections 88, 89 and 90, respectively, are in aligned registry with one another and help maintain the linear, laminar flow of water 16 along the flow trough 74 by distributing the water pressure across the width of the flow trough 74. The first and second channel sections 88 and 90, respectively, extend above a water level 91 flowing through the flow trough 74, while the intermediate channel section is below the water level 91.

As seen in FIGS. 2 and 4, the distal ends of the turning vanes 68 include six fixed water deflectors 92 that extend into the inlet portion 72 of the flow trough 74. The fixed water deflectors 76 are in aligned registry with the flow channels 87 of the first, intermediate and second channel sections 88, 89 and 90, respectively, and help to maintain the linear, laminar flow of water 16 as it leaves the flow manifold 22 and enters the flow trough 74.

Coupled to the flow trough 74 adjacent the inlet portion 72, are six further water deflectors 94 which are individually, pivotally connected by way of hinges 96 to the first end wall 78. The pivotable water deflectors 94 are a continuation of the side wall 36 of the flow manifold 22 and are in aligned registry with the flow channels 87 of the first, intermediate and second channel sections 88, 89 and 90, respectively.

A rod 98 extends between the side walls 84 of flow trough 74. Six threaded bolts 100 are slidably received within through openings formed within the rod 98. First ends 102 of the threaded bolts 100 are pivotally coupled to the pivotable water deflectors 94 through hinge mechanisms 104. Second ends 106 of the threaded bolts 100 can be grasped to slide the bolts 100 relative to the rod 98 as represented by directional arrow 108 (see FIG. 4) to pivot the individual, pivotable water deflectors about the hinges 96. Lock nuts 110 positioned to either side of the rod on each of the threaded bolts 100 lock the pivotable water deflectors 94 in the desired positions.

The pivotable water deflectors 94 are used to dampen the pressure distribution of the water flow to eliminate any difference in flow rate of the water 16 through the individual channels 87 of the first, intermediate and second channel sections 88, 89 and 90, respectively. By deflecting one of the pivotable water deflectors 94 downwardly, the flow rate of the water 16 at that particular channel 87 is decreased and the excess water pressure is distributed to the other channels 87. This arrangement helps to maintain the substantially laminar, linear flow of the water 16 along the flow trough 74.

As seen in FIGS. 1, 2 and 7, an adjustable plate member 112 extends between the side walls 84 of the flow trough 74 above the intermediate channel section 89. The plate member 112 is movable as represented by the directional arrow 114 (see FIG. 2) parallel to the channels 87. Above the first channel section 88 is an endless conveyor 116 positioned beneath a hopper 118. The hopper 118 holds a batch of food pieces, such as peas 120, that are metered out onto the conveyor 116 by a metering plate 122. The conveyor 112 transfers peas 120 from the hopper 118 and delivers those peas 120 to the proximal end of the plate member 112. The metering plate 122 regulates the height of peas 120 on the conveyor 116 and thereby the amount of peas 120 introduced to the linear flow of water within the flow trough 74. An angled divert plate 124 positioned between the distal end of the endless conveyor 116 and the proximal end of the plate member 112 assures that the peas 120 are directed onto the plate member 112. The plate member 112 supports the peas 120 until the peas 120 reach the velocity of the laminar, linear flow of water 16 in the flow trough 74. The peas 120 are then carried off the distal end of the plate member 112 by the water 16 where they free fall within the flow of water into a settling chamber 126.

The settling chamber 126 is located beneath the second channel section 90 and in fluid communication with the flow trough 74. The settling chamber 126 includes a plurality of cavity dividers 128 that are arranged perpendicular to the divider walls 86 (see FIG. 7). The cavity dividers are positioned at a 15° relative to a vertical plane 130 (see FIG. 2) which helps maintain the laminar flow of water along the flow trough 74. The settling chamber further includes a first collecting chamber 132 and a second collecting chamber 134 positioned distally or downstream of the first collecting chamber 132 and parallel to the channels 87 of the flow trough 74. The first collecting chamber 132 receives peas 120*a* having a high density range (i.e., a high starch concentration) which tend to settle out of the linear, laminar flow of the water 16 within the flow trough 74 at a fast rate of descent. The second collecting chamber 134 receives peas 120*b* having a low density range (i.e., a low starch concentration) which tend to settle out of the linear, laminar flow of the water 16 within the flow trough 74 at a rate of descent slower than the high starch peas 120*a*.

The first collecting chamber 132 is coupled to a first dewatering belt 136 by a first conduit 138. The second collecting chamber 134 is coupled to a second dewatering belt 140 by a second conduit 142. Water 16 separated by the first and second dewatering belts 136 and 140, respectively is returned back to the reservoir 14 as represented by the arrow 144, while high starch concentration peas 120*a* and low starch concentration peas 120*b* are taken away from pea separating apparatus 10. Water 16 returned to the reservoir 14 from the first and second dewatering belts 136 and 140 is recirculated back to the flow trough 74. The height of the water 16 flowing through the flow trough 74 is above the height of the discharge regions of the first and second conduits 138 and 142 at the first and second dewatering belts 136 and 140, respectively. This allows the supply system 12 to operate virtually on water head height alone once the water 16 is delivered to the flow trough 74, and thereby minimizes turbulence within the flow trough 74 which helps to maintain a laminar flow of water 16.

As seen in FIGS. 1 and 2, between the first and second collecting chambers 132 and 134 is an adjustable separating vane 146. The separating vane 146 is pivotally secured between the first and second collecting chambers 132 and 134 by a pivot mount 148. The separating vane 146 can be pivoted (as represented by the directional arrow 150 in FIG. 2) in various positions aligned with any one of the plurality of cavity dividers 128. The separating vane 146 is positioned to mark the separation point between high starch peas 120*a* and low starch peas 120*b*. The adjustable plate member 112 acts as a fine tuning mechanism for the separation point between high starch peas 120*a* and low starch peas 120*b* by varying the point at which the peas 120 start to free fall within the linear flow of the water 16 flowing through the flow trough 74.

Figure 8:
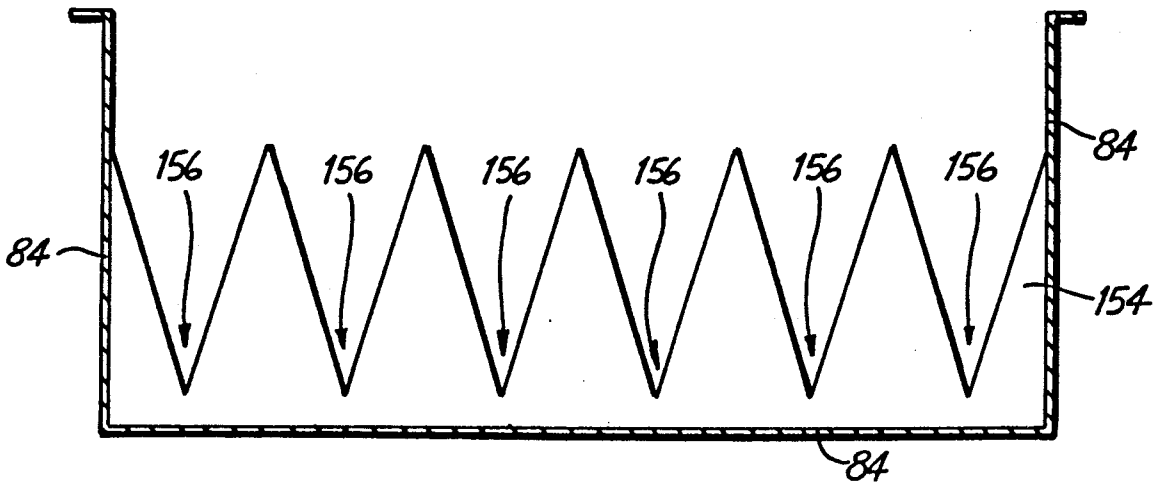
FIG. 8 is an end elevational view partially in section taken along line 8—8 in FIG. 7 illustrating the weir of a pea separating apparatus in accordance with the present invention.

As seen in FIGS. 1, 2 and 7, an outlet portion 152 of the flow trough 74 includes a weir 154. The weir 154 has a sawtooth shape that forms six V-shaped channels 156 (see FIG. 8) that are in aligned registry with the channels 87 of the flow trough 74. The weir 154 is designed to minimize any disturbance in the laminar, linear flow of water through the flow trough 74. Water 16 that passes over the weir 154 falls through the outlet portion 152 and through a dewatering screen 158 that removes debris and is returned to the reservoir (as represented by arrow 160) for recirculation back to the flow trough 74.

Coupled between the second supply line 24 and the first collecting chamber 132 is a third conduit 162. The third conduit 162 includes a valve 164 which can be adjusted to vary the rate of water flow to the first collecting chamber 132. The third conduit 162 further includes a water flow meter 166 which monitors the rate of water flow at that point. This assembly is used to increase flow of water 16 at the first collecting chamber 132 for assisting the transfer of high starch peas 120*a* from the first collecting chamber 132 to the first dewatering belt 136. This arrangement does not affect the descent rate of the peas 120 since the flow assist is minimal. As an option a fourth conduit 168 similar to the third conduit 162 can extend between the second supply line 24 and the second collecting chamber 134. The fourth conduit 168 can include a valve 170 and a water flow meter 172 similar to that found in the third conduit 162. This additional arrangement could be used to assist the flow of low starch peas 120*b* from the second collecting chamber 134 to the second dewatering belt 140 but does not affect the descent rate of the peas 120 since the flow assist is minimal.

In operation, as seen in FIG. 1, a batch of peas 120 is delivered to a processing plant containing the pea separating apparatus 10 via a truck 174. The batch of peas 120 is tested using AIS and/or a Tenderometer 176 to determine the starch concentrations within the peas 120. Data (i.e., feedforward control) 175 from the tests is used to position the separating vane 146 and the plate member 112 in accordance with starch concentration ranges to be desired to be collected in the first and second collecting chambers 132 and 134 (as represented by the arrow 177). The batch of peas 120 is delivered to a precleaner 178 for initial cleaning and then is delivered to a froth washer 180 via surge hoppers 182. From the froth washer 180 the peas 120 are graded by size via a size grader 184 and then are blanched using a blancher 186. The blancher 186 is an important part of the separating process since the blancher 186 removes air from the batch of peas 120. Air within the peas 120 could affect the descent rate of the peas 120 in the settling chamber 126.

Peas 120 from the blancher 186 are delivered to the hopper 118 which feeds the peas 120 onto the conveyor 116 where they are delivered to the plate member 112. The peas 120 travel along the plate member 112 where they obtain the velocity of the water 16 flowing through the flow trough 74. The peas 120 free fall off the end of the plate member 112 where they descend at differing rates depending upon density through the separating chamber 126. Peas 120*a* of high starch concentration (i.e., peas within a high density range) descend faster and are received in the first collecting chamber 132. Peas 120*b* having a low starch concentration (i.e., peas with a low density range) tend to descend at a slower rate and are thereby received in the second collecting chamber 134. The peas 120*a* and 120*b* are taken from the first and second collecting chambers 132 and 134 to the first and second dewatering belts 136 and 140, respectively. Water 16 from the first and second dewatering belts 136 and 140 and water 16 that passes over the weir 154 is returned back to the reservoir 14 where it is then recirculated back to the flow trough 74.

During the separation process on the batch of peas 120, a sample of peas 120*b* are periodically taken from the second dewatering belt 140 and retested. The sample of peas 120*b* is introduced into a near infrared reflectance (NIR) analyzer 183, such as the InfraAlyzer 450 available from Bran+Luebbe Analyzing Technologies Inc. The near infrared analyzer 183 directs light against the sample of peas 120*b* and determines the absorbance values of the sample of peas 120*b* at various wavelengths. These absorbance values are fed into a microprocessor 185, which plugs the absorbance values into a linear equation formulated by the statistical analysis of AIS values from prior batches of peas from previous harvests. The linear equation produces a new AIS value. The plate member 112 and the separating vane 146 are then adjusted (as represented by the arrow 187) in accordance with this new AIS value (i.e., feedback 188) to accommodate starch concentration fluctuations within the batch of peas 120 currently being separated. The absorbance values from the retesting of the sample of peas 120*b* are used by the microprocessor 183 to adjust the linear equation. In addition, traditional wet chemistry AIS tests are run on the sample of peas 120*b* to check the AIS value obtained from the near infrared analyzer 183 and microprocessor 185.

This pea separating apparatus 10 is relatively uncomplicated. By separating mature peas 120*a* (i.e., high starch concentration peas) from young peas 120*b* (i.e., low starch concentration peas) using a recirculating linear, laminar flow of water 16, the need for a brine solution has been eliminated. Together with the elimination of the brine solution itself, the problems of corrosion of equipment and the disposal of the brine solution without harm to the environment have been addressed. In addition, the use of a linear, laminar flow of water 16 to separate the peas 120 does away with the salty taste that could accompany peas separated in a brine solution. The adjustable plate member 112 and separating Vane 146 readily permit the separation process of the pea separating apparatus 10 to be quickly adjusted to accommodate batches of peas 120 having differing starch concentrations. Moreover, by retesting the separated peas 120*a* and 120*b* during the separating process the plate member 112 and separating vane 146 can be quickly readjusted to accommodate starch concentration fluctuations within the batch of peas 120 currently being separated.

Although the present invention has been described with reference to preferred embodiments, workers skilled in the art will recognize that changes may be made in form and detail without departing from the spirit and scope of the invention.

What is claimed is:

1. An apparatus for separating food pieces based upon differences in density, comprising:

a flow trough having an inlet at a first end and an outlet at a second end;

means for delivering a fluid medium to the inlet of the flow trough for establishing a linear fluid medium flow from the inlet toward the outlet;

means positioned distally of the inlet for introducing a continuous supply of food pieces to the linear flow within the flow trough;

a separating chamber positioned beneath and in fluid communication with the flow trough between the inlet and outlet, and positioned distally of the delivery means, including:

a first collecting chamber for receiving food pieces having a first predetermined density range, which settle out of the linear flow of fluid medium at a first rate of descent; and a second collecting chamber positioned distally of the first collecting chamber for receiving food pieces having a second density range different from the first density range, which settle out of the linear flow of fluid medium at a second rate of descent which is slower than the first rate of descent.

2. The separating apparatus of claim 1 wherein the fluid medium delivery means, includes:

a reservoir for containing a supply of the fluid medium; and a pump member coupled between the reservoir and the inlet of the flow trough for delivering a continuous flow of fluid medium to the flow trough.

3. The separating apparatus of claim 2 wherein the fluid medium delivery means further includes:

a flow manifold coupled between the pump member and the inlet of the flow trough, the flow manifold including a lower portion having end walls that taper outwardly to allow the flow of fluid medium supplied from the pump to expand and become substantially laminar.

4. The separating apparatus of claim 3 wherein the flow manifold further includes an upper portion having divider members that help maintain the substantially laminar flow of fluid medium.

5. The separating apparatus of claim 3 wherein the fluid medium delivery means further includes:

a fluid medium supply line coupling the pump member to an inlet portion of the flow manifold, including:

a flow nipple extending into the lower portion of the flow manifold to assist the fluid medium in becoming substantially laminar flow.

6. The separating apparatus of claim 5 wherein the flow nipple is threadably received in the fluid medium supply line and the lower portion of the flow manifold to allow the extent to which the flow nipple extends into the flow manifold to be varied as a function of the degree of laminar flow desired.

7. The separating apparatus of claim 6 wherein the flow nipple further includes a semi-circular lip portion extending into the lower portion of the flow manifold.

8. The separating apparatus of claim 7 wherein the lip portion of the flow nipple includes a V-shaped notch which assists in distributing fluid medium pressure to achieve substantially laminar flow.

9. The separating apparatus of claim 1 wherein the flow trough includes:

a plurality of divider walls positioned parallel to a longitudinal extent of the flow trough and parallel to the linear flow of fluid medium within the flow trough, the plurality of divider walls defining a first section of channels positioned proximally of the delivery mechanism and a second section of channels positioned distally of the delivery mechanism, the first and second section of channels allowing the linear flow of fluid medium to become substantially laminar.

10. The separating apparatus of claim 9 wherein the flow trough further includes:

a plurality of fluid medium deflectors pivotally attached to the flow trough adjacent the inlet and being in aligned registry with the first and second sections of channels, and an adjusting mechanism associated with each fluid medium deflector such that each deflector can be independently adjusted to insure that the linear flow of fluid medium is substantially laminar.

11. The separating apparatus of claim 9 wherein the separating chamber is positioned beneath the second section of channels and includes a plurality of cavity dividers arranged perpendicular to the divider walls and defining a plurality of separating chamber channels.

12. The separating apparatus of claim 11 wherein the separating chamber further includes:

a separating vane pivotally attached between the first and second collecting chambers, the separating vane being alignable with any one of the cavity dividers to separate the first collecting chamber from the second collecting chamber as a function of the first and second density ranges desired to be collected in the first and second collecting chambers, respectively.

13. The separating apparatus of claim 12 wherein the flow trough further includes:

a plate member positioned between the first and second section of channels, the plate member receiving food pieces from the delivery mechanism and supporting the food pieces until the food pieces reach the velocity of the linear flow of fluid medium within the flow trough at which time the food pieces leave the plate member and descend through the separating chamber to be collected in the first and second collecting chambers.

14. The separating apparatus of claim 13 wherein the plate member is linearly adjustable along the longitudinal extent of the flow trough as a function of the first and second density ranges to be collected in the first and second collecting chambers, respectively.

15. The separating apparatus of claim 14, and further including:

an analyzer for testing the food pieces received within the second collecting chamber for providing data to be used to adjust the separating vane and plate member in accordance with the first and second density ranges to be collected in the first and second collecting chambers, respectively.

16. The separating apparatus of claim 15 wherein the analyzer is a near infrared reflectance analyzer.

17. The separating apparatus of claim 2 wherein the flow trough includes a weir having a saw-tooth configuration positioned proximally the outlet of the flow trough.

18. The separating apparatus of claim 2 wherein the reservoir is positioned beneath the outlet of the flow trough such that fluid medium is recirculated from the reservoir through the flow trough and back to the reservoir.

19. The separating apparatus of claim 13 wherein the food pieces introducing means includes:

a hopper containing a batch of food pieces, and an endless conveyor positioned beneath the hopper for transferring a continuous supply of food pieces from the hopper to the plate member.

20. The separating apparatus of claim 2 wherein:

the first collecting chamber includes a first flow line for carrying food pieces within the first density range and fluid medium from the first collecting chamber to a first defluidizing belt, whereby the food pieces within the first density range are carried away and the separated fluid medium is recirculated back to the reservoir, and the second collecting chamber includes a second flow line for carrying food pieces having within the second density range and fluid medium from the second collecting chamber to a second defluidizing belt, whereby the food pieces within the second density range are carried away and the separated fluid medium is recirculated back to the reservoir.

21. The separating apparatus of claim 20, wherein the fluid medium delivery means further includes a fluid line coupled between the pump member and the first collecting chamber for delivering fluid medium to the first collecting chamber to assist the flow of food pieces within the first density range out of the first collecting chamber and through the first flow line.

22. The separating apparatus of claim 1 wherein the density differences between individual food pieces is a function of the starch concentration within each of the food pieces, whereby food pieces with high starch concentrations have higher densities and thereby settle out of the linear flow of fluid medium at the first rate of descent into the first collecting chamber, and whereby food pieces with low starch concentrations have lower densities and thereby settle out of the linear flow of fluid medium at the second rate of descent into the second collecting chamber.

23. A method of separating a batch of food pieces in a separating apparatus based upon the concentration of starch within the food pieces of the batch of food pieces comprises the steps of:

providing a flow trough having a separating chamber positioned beneath and in fluid communication with the flow trough, the separating chamber including first and second collecting chambers;

testing the batch of food pieces to determine the relative concentrations of starch within the food pieces of the batch of food pieces;

setting the separating apparatus in accordance with data obtained from testing such that the first collecting chamber will receive food pieces within a first range of starch concentrations and the second collecting chamber will receive food pieces within a second range of starch concentrations;

precleaning the batch of food pieces to be separated using a precleaner;

washing the batch of food pieces using a froth washer;

grading the batch of food pieces according to size;

blanching the batch of food pieces to remove air;

supplying a substantially laminar, linear flow of fluid medium through the flow trough;

introducing the batch of food pieces in a continuous manner to the flow trough such that the food pieces achieve the velocity of the linear flow of fluid medium; and separating the batch of food pieces based upon the concentration of starch within the food pieces by allowing the food pieces to settle out of the linear flow of fluid medium through the separating chamber such that food pieces within the first range of starch concentrations have a higher density and settle out faster and are received in the first collecting chamber, whereas food pieces within the second range of starch concentrations have a lower density and settle out slower relative to the food pieces within the first range of starch concentrations and are received in the second collecting chamber.

24. The method of claim 23, further including the steps of:

transferring the food pieces within the first and second ranges of starch concentrations from the first and second collecting chambers, respectively, to first and second defluidization belts, respectively;

periodically retesting the food pieces on the second defluidization belt to determine relative concentrations of starch within the food pieces; and resetting the separating apparatus in accordance with additional data obtained from retesting such that the first collecting chamber will receive food pieces within a re-established first range of starch concentrations and the second collecting chamber will receive food pieces within a re-established second range of starch concentrations.

25. The method of claim 24 wherein periodically retesting the food pieces on the second defluidization belt to determine relative concentrations of starch within the food pieces includes:

introducing a sample of food pieces from the second defluidization belt to an analyzer; and activating the analyzer to test the sample of food pieces and obtain data related to the relative concentrations of starch within the sample of food pieces.

26. The separating apparatus of claim 23 wherein the food pieces are peas.

27. The separating apparatus of claim 23 wherein the fluid medium is water.

* * * * *